US005537778A

United States Patent [19]

Bardwell et al.

[11] Patent Number: 5,537,778

[45] **Date of Patent: *Jul. 23, 1996**

[54] SECURITY BARRIER APPARATUS

[75] Inventors: Allen E. Bardwell; Herbert W. Morgan, both of Front Royal, Va.

[73] Assignee: Trident Industries, Inc., Front Royal, Va.

[ * ] Notice: The term of this patent shall not extend beyond the expiration date of Pat. No. 5,452,542.

[21] Appl. No.: 498,825

[22] Filed: Jul. 6, 1995

Related U.S. Application Data

[63] Continuation-in-part of Ser. No. 328,527, Oct. 25, 1994, Pat. No. 5,452,542.

[51] Int. Cl.[6] ..... E01F 13/00

[52] U.S. Cl. ..... 49/34; 49/9; 49/322

[58] Field of Search ..... 49/34, 9, 322; 160/328

[56] References Cited

U.S. PATENT DOCUMENTS

| | | | |
|---|---|---|---|
| 353,368 | 11/1886 | Miller . | |
| 484,572 | 10/1892 | Rudert . | |
| 1,188,866 | 6/1916 | Wexler | 49/322 X |
| 1,277,201 | 8/1918 | Doser | 49/9 X |
| 1,832,812 | 11/1931 | Keenan | 49/34 |
| 2,663,103 | 12/1953 | Ellison | 49/34 |
| 4,333,268 | 6/1982 | Dumbeck . | |
| 4,553,739 | 11/1985 | Baines | 49/34 X |
| 5,245,787 | 9/1993 | Swenson et al. . | |

FOREIGN PATENT DOCUMENTS

| | | | |
|---|---|---|---|
| 672772 | 10/1964 | Italy | 49/34 |

*Primary Examiner*—Philip C. Kannan
*Attorney, Agent, or Firm*—Dowell & Dowell

[57] ABSTRACT

A security barrier apparatus suitable for use in residential, farm and industrial settings includes a motor, a chain and a brake mechanism for engaging the chain. The apparatus is mounted to a first support such as a post. The chain extends from the first support to a second spaced support and is raised and lowered relative to the ground by operation of the motor. The motor may be remotely actuated by an electronic transmitter. The apparatus further includes protective features to prevent damage to the motor in the event that a vehicle collides with the chain.

20 Claims, 10 Drawing Sheets

SECURITY BARRIER APPARATUS

CROSS-REFERENCE TO RELATED APPLICATIONS

This application is a continuation-in-part of U.S. Pat. application Ser. No. 08/328,527, filed Oct. 25, 1994 and now U.S. Pat. No. 5,452,542.

BACKGROUND OF THE INVENTION

1. Technical Field

The present invention relates to the field of gates and, more particularly, to an automated security barrier apparatus suitable for use in residential, farm and industrial settings.

2. Background of the Related Art

Automated apparatuses for opening and closing gates have had a long history of development. Such apparatuses have been developed to secure against entry into areas, and to allow individuals to enter such areas without having to exit from their vehicles. The known apparatuses include, for example, powered gates having laterally sliding metal gates, folding metal doors, and bars that are raised and lowered.

Chains have also been used as an entry barrier in security gate apparatuses. The known apparatuses include link chains anchored on one side of a drive leading to a secured area and locked on the opposite side of the drive. These apparatuses require individuals to leave their vehicles, lower the chain, drive through, and then stop and reattach and lock the chain. Such apparatuses are inadequate due to the time required to perform these manual steps, especially in bad weather and in poorly lighted areas were personal safety is a concern.

Entry barrier apparatuses utilizing a chain are disclosed in U.S. Pat. No. 353,368 to Miller, U.S. Pat. No. 484,572 to Rudert and U.S. Pat. No. 4,333,268 to Dumbeck. The disclosed apparatuses include moving components which are installed underground. Consequently, the components are exposed to water and to sleet and ice in colder environments, causing accelerated wear of the apparatuses.

Other entry barrier apparatuses utilizing a chain and including above-ground components are disclosed in U.S. Pat. No. 2,663,103 to Ellison and U.S. Pat. No. 4,553,739 to Baines.

A cable gate apparatus is disclosed in U.S. Pat. No. 5,245,787 to Swenson et al., which includes a slide member mounted in a track to raise a lift arm and gate cable to a raised position.

In view of the above-described inadequacies of the known security barriers, there has been a need for a chain-type security barrier apparatus which is remotely actuated by persons without having to leave the safety and comfort of their vehicles, durable, weather resistant, simple in construction and easy to install.

SUMMARY OF THE INVENTION

The present invention has been made in view of the above-described inadequacies of the known security barrier apparatuses and has as an object to provide a chain-type security barrier apparatus can be remotely actuated.

Another object of the present invention is to provide a security barrier apparatus which is weather resistant.

A further object of the invention is to provide a security barrier apparatus which is durable, simple in construction and easy to install.

A still further object of the invention is to provide a security barrier apparatus having protective features to prevent the apparatus being damaged by a vehicle colliding with the chain.

To achieve the foregoing objects and advantages of the invention, as embodied and broadly described herein, the security barrier apparatus in accordance with a preferred embodiment of the invention is suitable for use with spaced first and second supports which protrude upwardly from a surface. The apparatus is adapted to be mounted to one of the supports. The apparatus comprises a reversible motor, a reel which is connected to and rotatably driven by the motor, and a chain secured to the reel. The chain is wound and unwound on the reel by operation of the motor in respective winding and unwinding directions.

The chain is adapted to extend from the first support to the second support. The chain is raised above the surface by operation of the motor in the winding direction, and is lowered onto the surface by operation of the motor in the unwinding direction.

The apparatus preferably further comprises a brake means for engaging the chain. The brake means defines an opening and the chain is movable through the opening when the brake means is in a non-braking condition and the motor is operating.

The apparatus may further comprise a limiting means for limiting the length of chain which may be protracted when the brake means is in the non-braking condition, and a housing to surround the moving components and protect them from the weather.

DETAILED DESCRIPTION OF THE PREFERRED EMBODIMENTS

Figure 1:
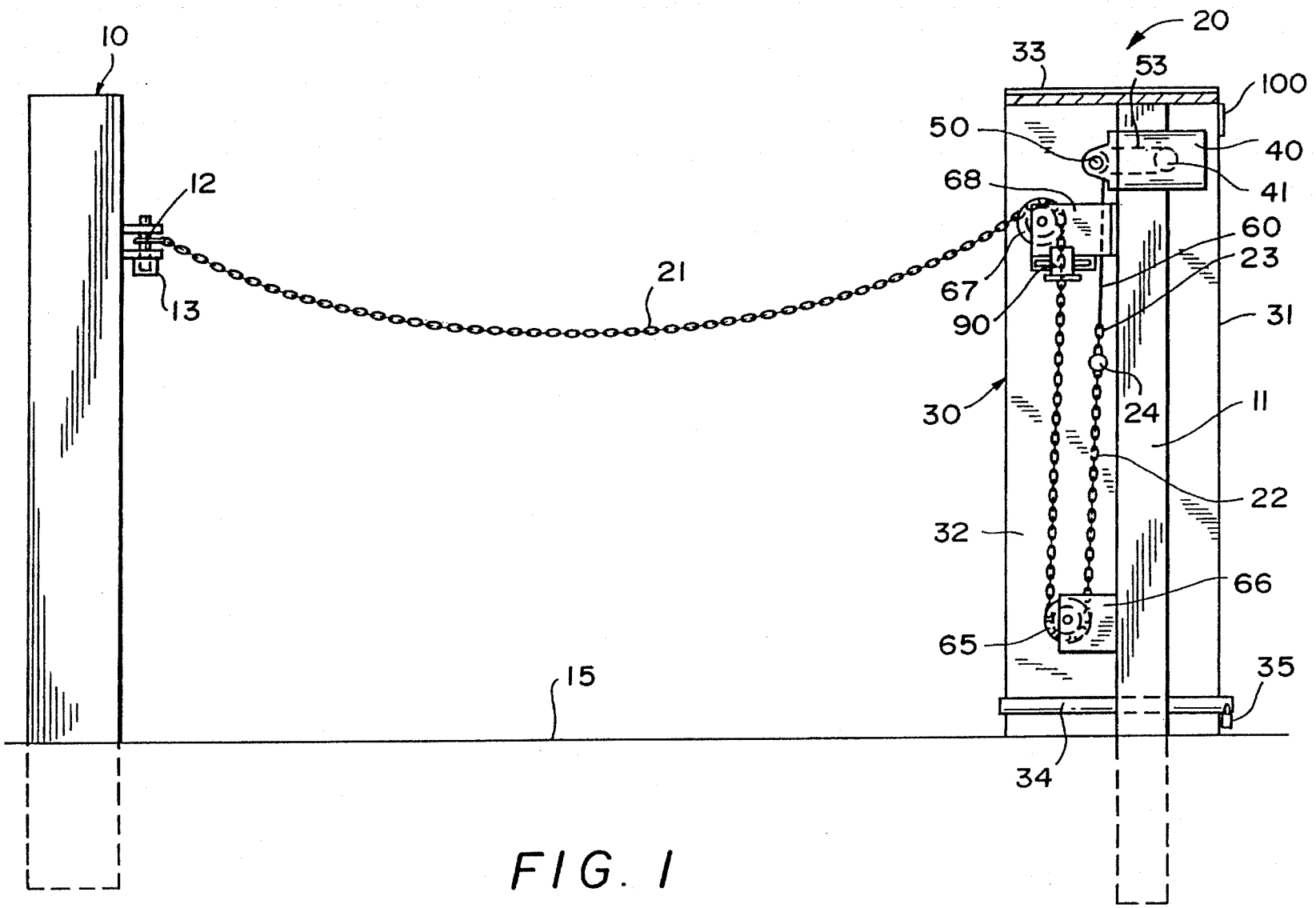
FIG. 1 is a side elevational view illustrating a security barrier apparatus in accordance with a preferred embodiment of the invention, with the barrier in a raised position.

The preferred embodiments of the invention will now be described with reference to the drawing figures. In the drawings, common elements are identified by common reference numbers.

FIG. 1 illustrates a security barrier apparatus 20 in accordance with a preferred embodiment of the invention, as used in combination with a pair of spaced support posts 10, 11. The posts are partially embedded in the ground on opposite sides of a drive 15 which leads to a secured area. The apparatus may be mounted to any type of post, pole or fence, or to trees and other supports.

The apparatus 20 comprises a chain 21 which extends between the posts 10, 11 and, in the illustrated raised position, forms a barrier to vehicles. The chain is shown secured to a bracket 12 by a fastener 13. The chain may be locked to the post 10 to prevent it from being disconnected.

The apparatus 20 further comprises a housing 30 which is mounted to the post 11 and surrounds the moving components of the apparatus. As shown in FIG. 1, the housing includes a back wall 31, opposed side walls 32 (only one sidewall is shown), and a top wall 33. The top wall 33 is secured to the upper end of the post 11, and the back wall 31 is secured to a lower portion of the post by a rod 34 or the like, which in turn is fastened to the post. The rod is preferably secured to the housing by a lock 35 to prevent the housing from being separated from the post. The housing is open at the bottom and includes a front wall (not shown) which is removable from the remainder of the housing to access the enclosed components. The front wall defines an opening (not shown) through which the chain extends.

The housing 30 protects the enclosed components of the security barrier apparatus from being exposed to rain and other forms of precipitation which accelerate wear. The housing is preferably formed of a lightweight, weather resistant material such as fiberglass or the like, to enable the housing to be easily removed from the post 11 for repair purposes. The housing may optionally be formed of a more rigid material such as a metal. In addition to protecting the enclosed components, the housing improves the appearance of the apparatus.

The apparatus 20 further comprises a motor 40 which is mounted to the post 11 near its upper end. The motor is reversible and preferably electrically powered. The motor may optionally be powered by a battery or a solar energy device (not shown). The motor is preferably actuated by an electronic transmitter carried in a vehicle. In this manner, when the chain 21 is raised, only persons having such a transmitter may operate the motor to lower the chain. Referring to FIG. 1, the motor may optionally be actuated by an electronic keypad 100 mounted, for example, to the housing 30, to enable those individuals not having a transmitter, but having knowledge of the operating code, to lower the chain.

Figure 3:
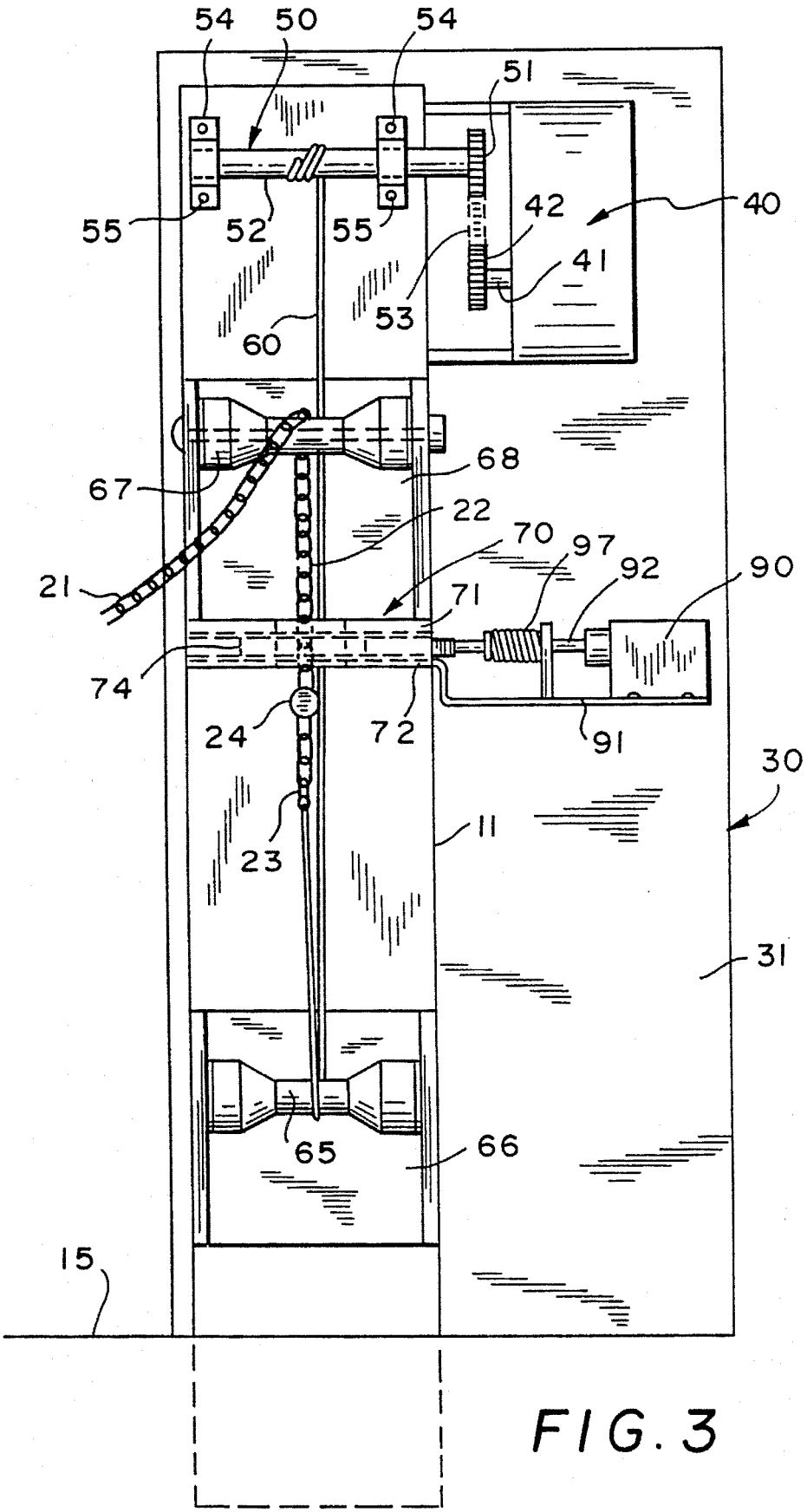
FIG. 3 is a front elevational view of the security barrier apparatus in the direction of line 3—3 of FIG. 2.

As illustrated in FIG. 3, the motor 40 includes a drive shaft 41 and a drive sprocket 42 mounted on the drive shaft.

A winch-type reel 50 is mounted to the post 11 above the motor 40. The reel includes a reel sprocket 51 mounted on a reel shaft 52. A connecting chain 53 connects the drive sprocket 42 of the motor to the reel sprocket. The reel shaft and reel sprocket are held in position by spaced pillow blocks 54 secured to the post by fasteners 55.

A cable 60 is attached at one end to the reel shaft 52 and is connected at its opposite end at 23 to the chain 21. The cable is wound and unwound by reverse operation of the motor, to cause the chain to be retracted and protracted, respectively, from within the housing. As shown in FIG. 1, the cable extends downward from the reel close to the post 11 to prevent interference with the chain.

The reel 50 enables the cable 60 to be used to move the chain 21. Because the cable is relatively small in diameter, the reel is also small in diameter. The small diameter of the reel shaft creates a high amount of leverage and decreases the stress on the motor when a heavy chain is being wound.

The length of the chain 21 is selected so that in the raised position shown in FIG. 1, the chain extends downward from the cable 60 and around a lower pulley 65 mounted to the post 11 by a bracket 66, upward around an upper pulley 67 mounted to the post 11 above the lower pulley by a bracket 68, and across the drive 15 to the post 10.

Referring to FIG. 3, the chain 21 preferably includes a frangible link 22 located near the connection 23 between the cable 60 and the chain. The frangible link has a small section removed so that it opens and releases the major portion of the chain from the cable when subjected to a predetermined stress. The link prevents any potentially damaging stress being transmitted through the chain and to the drive shaft 41 and drive sprocket 42 of the motor 40. The tension of the chain looping around the lower pulley 65, the upper pulley 67 and the reel 50, is sufficient to enable the frangible link to open when subjected to the predetermined stress. The predetermined stress is below a stress level which may damage the reel or the motor.

The posts 10, 11 are preferably anchored in cement (not shown) to support the extended chain and remain upstanding if a vehicle collides with the apparatus.

Figure 2:
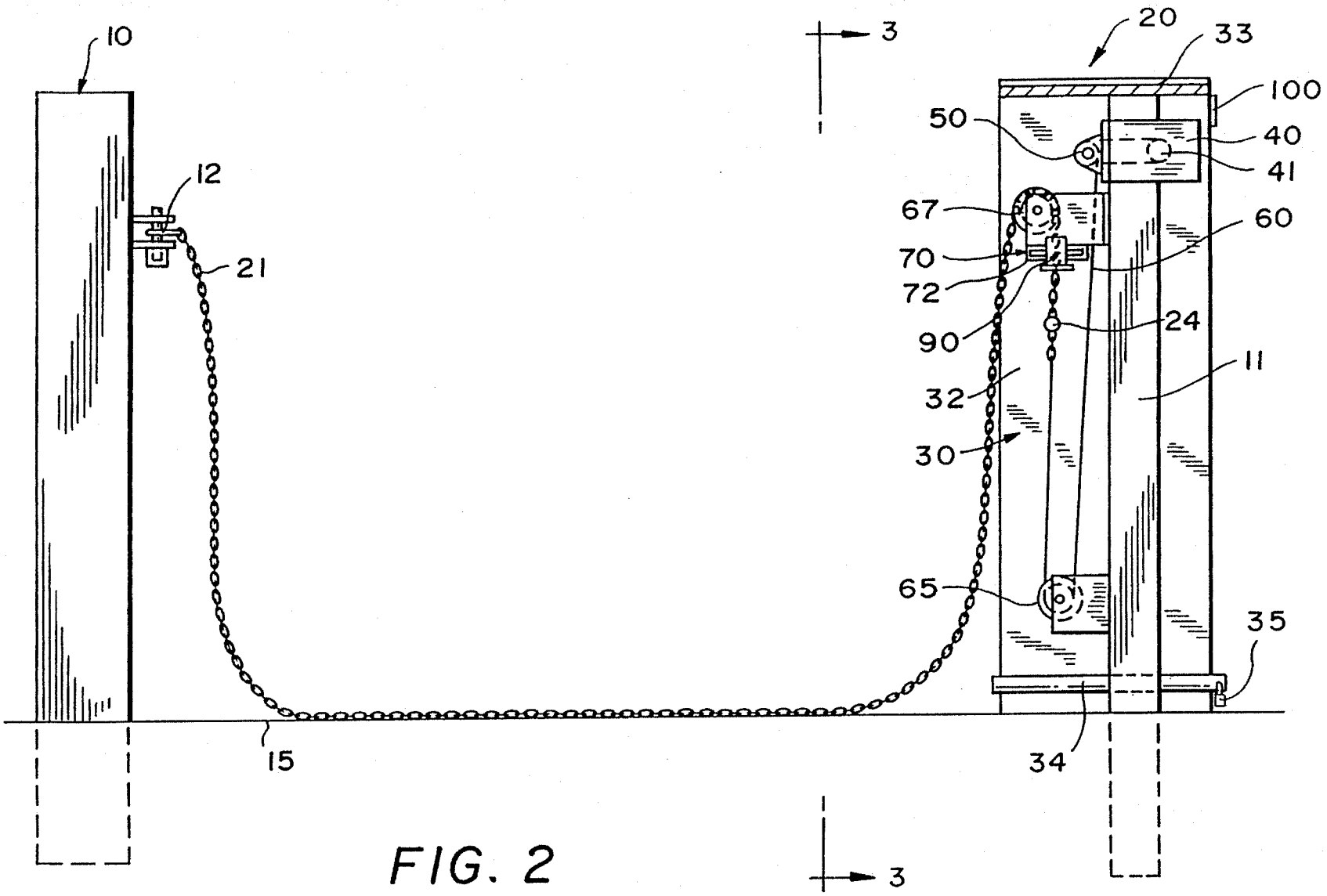
FIG. 2 is a side elevational view illustrating the barrier of the apparatus of FIG. 1 in a lowered position.

The apparatus further comprises means for limiting the length of chain which may be protracted from the apparatus. The limiting means preferably comprises a circular-shaped stop 24 disposed on the chain near the connection 23. As illustrated in FIG. 2, when the chain is lowered, the stop 24 is positioned near the lower surface of a brake means 70 for engaging the chain. If a vehicle or other object engages the chain when the brake means is in a non-braking condition, the stop is raised until it abuts the lower surface of the brake means and prevents additional chain from being protracted. Consequently, if the chain is subjected to a stress higher than the predetermined strength of the frangible link 22, the frangible link fails and releases the chain to prevent transmission of the stress to the reel 50 and motor 40.

The stop may optionally be an enlarged chain link (not shown) provided in the chain, and of a size so as to be unable to pass upward through the brake means.

Figure 4:
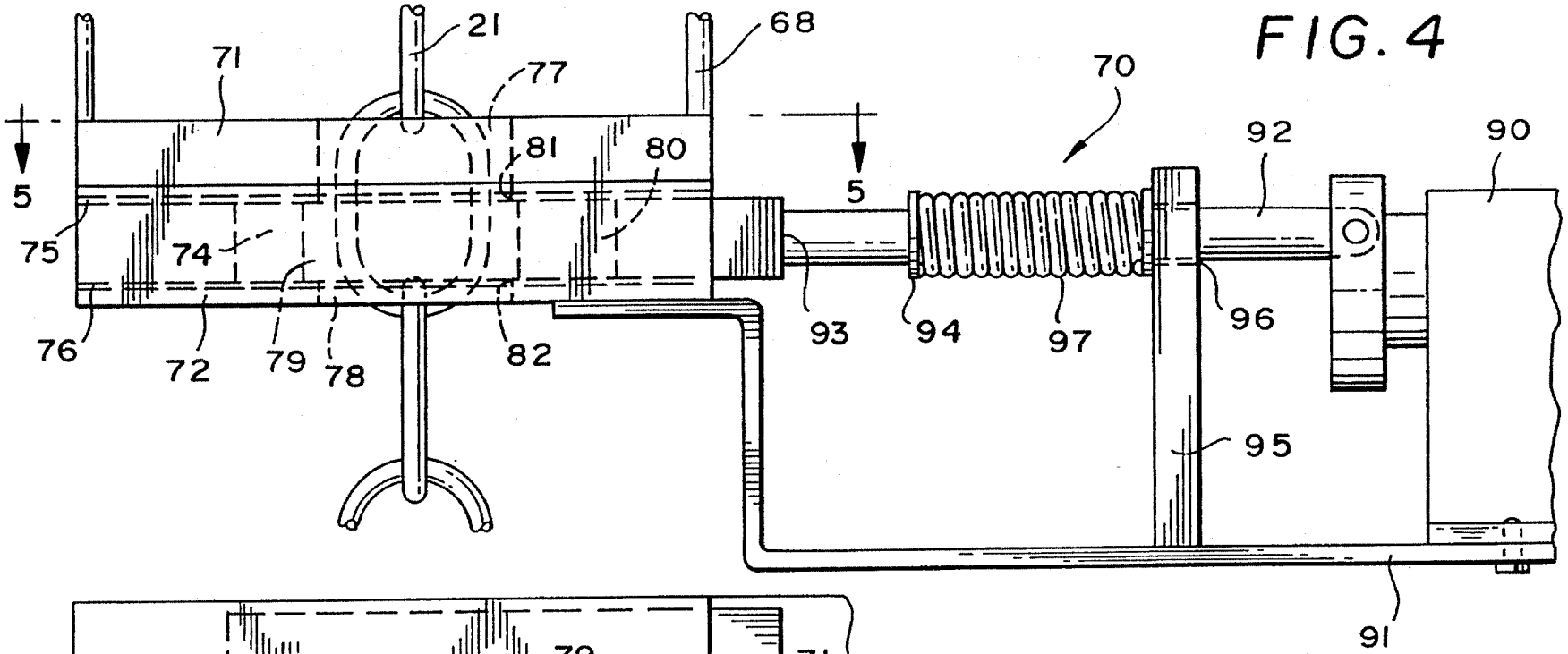
FIG. 4 is a side elevational view of a portion of the chain brake mechanism of the security barrier apparatus in a non-braking condition.
Figure 9:
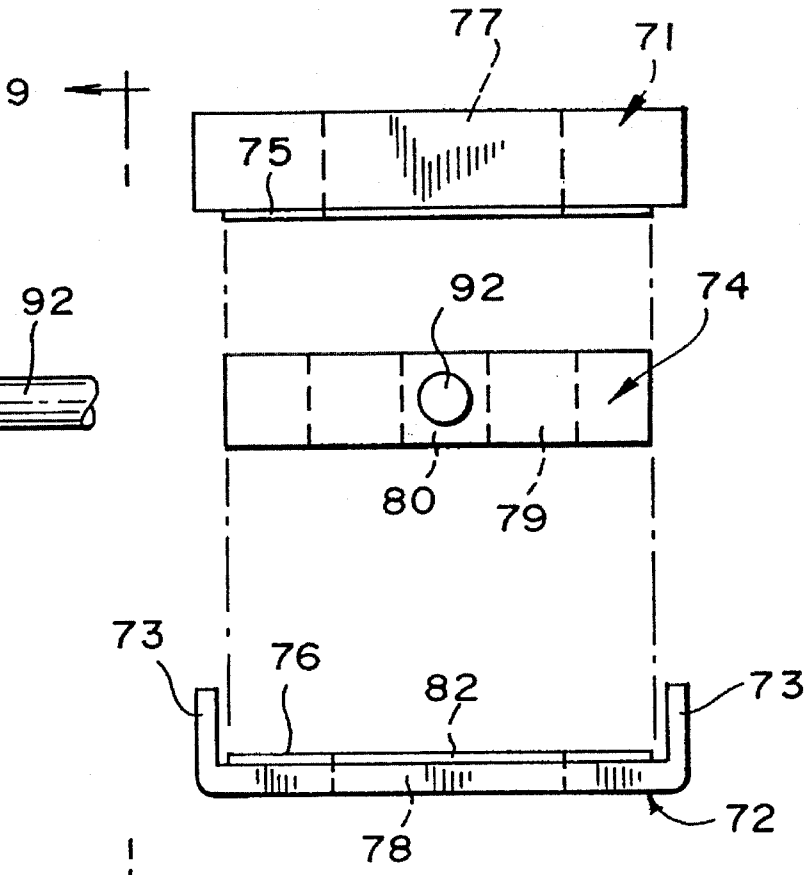
FIG. 9 is an exploded front view in the direction of line 9—9 of FIG. 8.
Figure 8:
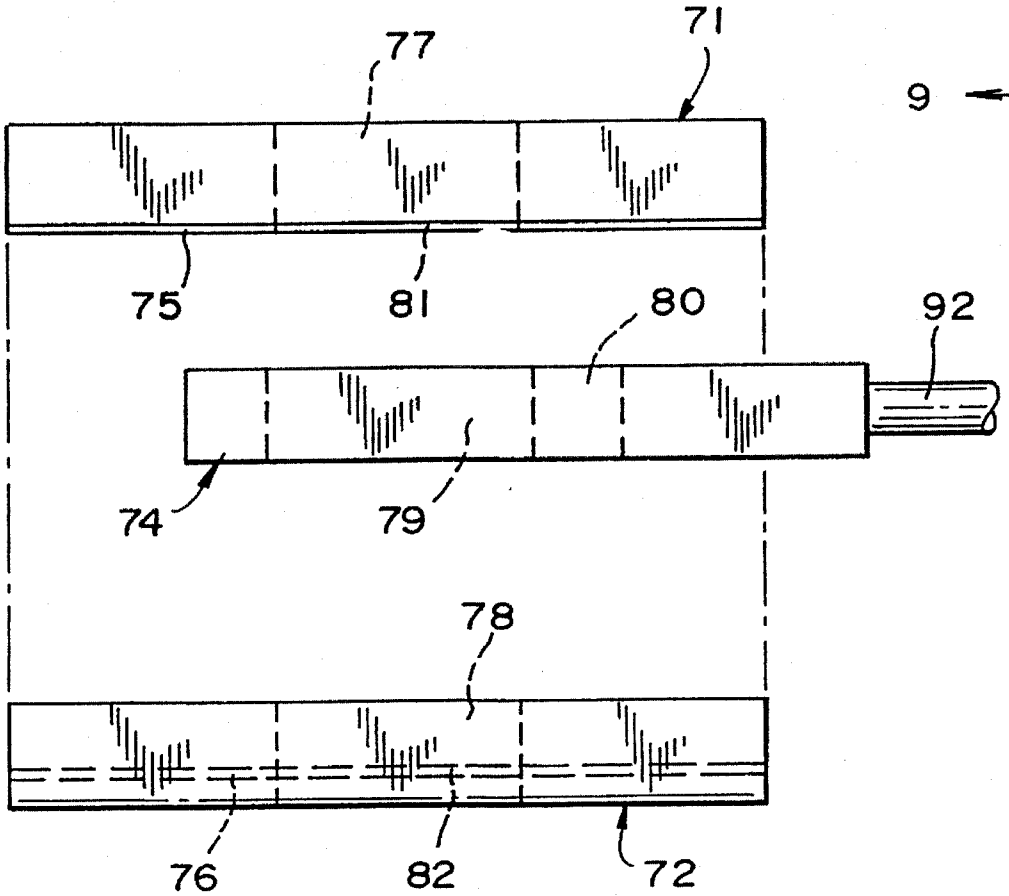
FIG. 8 is an exploded side view illustrating the fixed plates and sliding plate of the chain brake.
Figure 10:
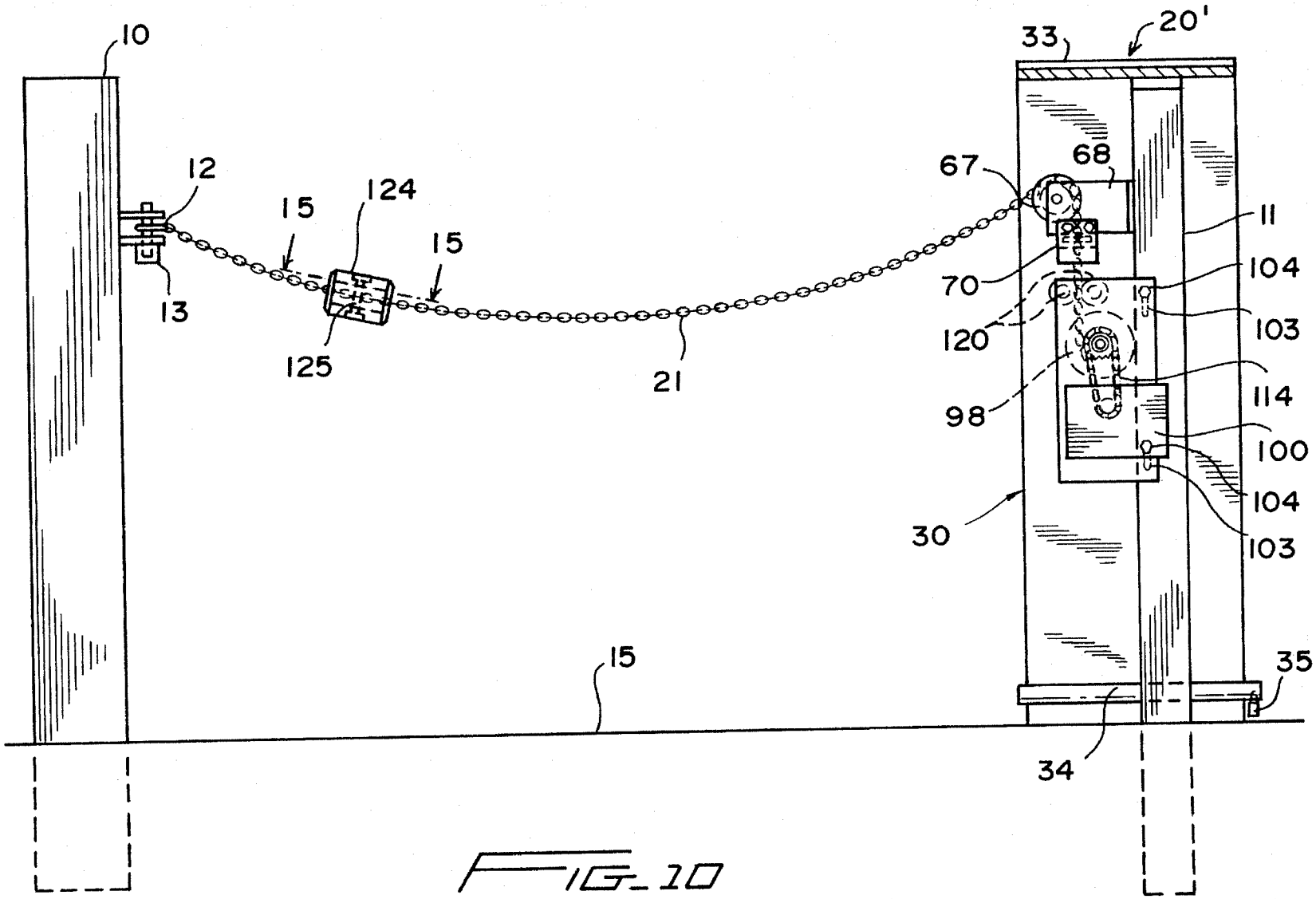
FIG. 10 is an illustrational view of a security barrier apparatus in accordance with another preferred embodiment of the invention, with the barrier in a raised position.

As illustrated in FIG. 4, the brake means 70 preferably comprises a solenoid-controlled chain brake mechanism. The chain brake includes an upper fixed plate 71 and a lower fixed plate 72. With reference to FIG. 9, the lower fixed plate 72 has a U-shaped cross-section and includes upward extending sidewalls 73 which are attached to the upper fixed plate 71. The fixed plates are secured to the bracket 68. As shown in FIG. 3, the bracket 68 is fastened to the post 11.

Referring to FIG. 4, a sliding plate 74 is disposed between the fixed plates. Lubricating plates 75, 76 composed of a lubricating material such as TEFLON™ are placed between the fixed plates 71, 72 and the sliding plate to enable the sliding plate to slide with reduced friction.

Figure 5:
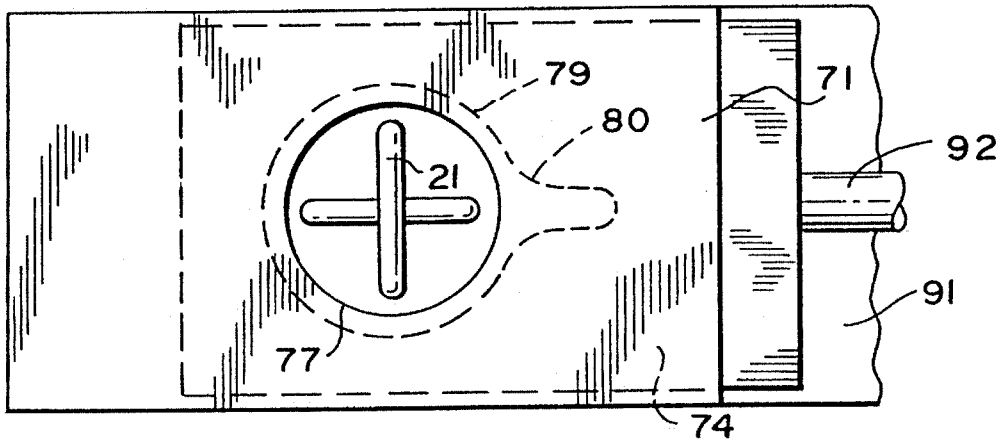
FIG. 5 is a top plan view in the direction of line 5—5 of FIG. 4, showing the sliding plate of the chain brake in a retracted position.

The fixed plates 71, 72 define aligned, preferably circular shaped openings 77, 78, respectively. Referring to FIG. 5, the sliding plate 74 defines an opening having a circular portion 79 and an elongated portion 80 in communication with the circular portion. The lubricating plates 75, 76 also include circular shaped openings 81, 82, respectively (FIG. 4), which are aligned with the circular openings in the fixed plates. The circular openings of the fixed plates and the lubricating plates, and the circular portion of the opening of the sliding plate, are of approximately the same diameter, which is selected to allow the chain to pass through the plates. The circular opening of at least the lower fixed plate 72 is smaller than the diameter of the stop 24 to limit the upward movement of the stop and, thus, also the chain 21. At its uppermost position, the stop abuts the bottom face of the lower fixed plate 72 and prevents further upward movement of the chain.

With further reference to FIG. 4, the chain brake 70 comprises a solenoid 90 which is mounted on a bracket 91 secured to the lower fixed plate 72. The solenoid includes a retractable shaft 92 which is attached at its tip 93 to the sliding plate 74. A first, fixed vertical plate 94 is disposed on the shaft. A second, fixed vertical plate 95 is mounted to the bracket 91 and defines an opening 96 through which the shaft 92 reciprocates when the solenoid is actuated and deactivated. A coil spring 97 is positioned on the shaft between the plates 94, 95.

As illustrated in FIG. 4, when the solenoid 90 is actuated, the shaft 92 and sliding plate 74 are pulled away from the fixed plates 71, 72, and the spring 97 is compressed between the vertical plates 94, 95. When the shaft is fully retracted as shown, the circular portion 79 of the opening of the sliding plate is aligned with the openings 77, 78 in the fixed plates 71, 72, respectively, and the openings 81, 82 in the lubricating plates 75, 76, respectively. As shown in FIG. 5, the chain is able to move upward and downward through the chain brake.

Figure 6:
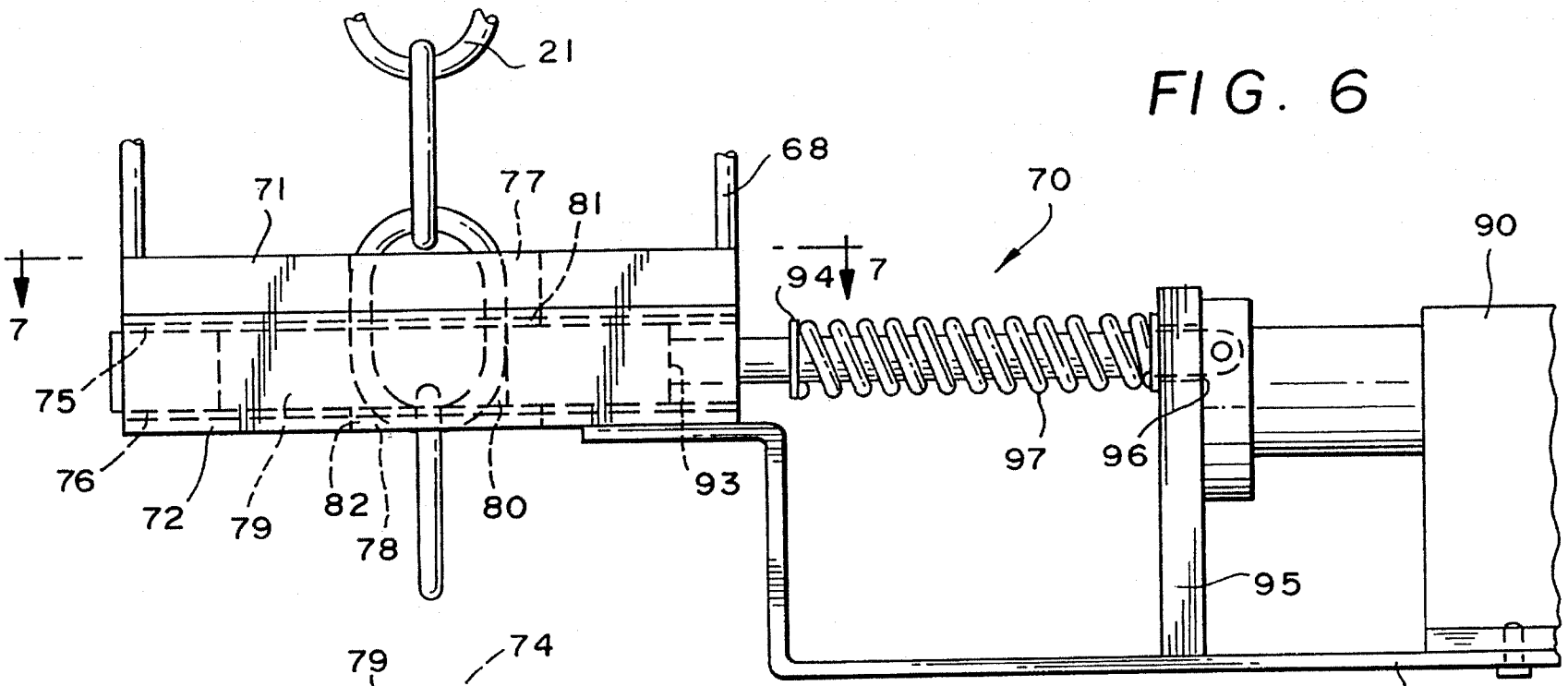
FIG. 6 is a side elevational view of a portion of the chain brake of the security barrier apparatus in a braking condition in which the chain is engaged by the sliding plate.
Figure 7:
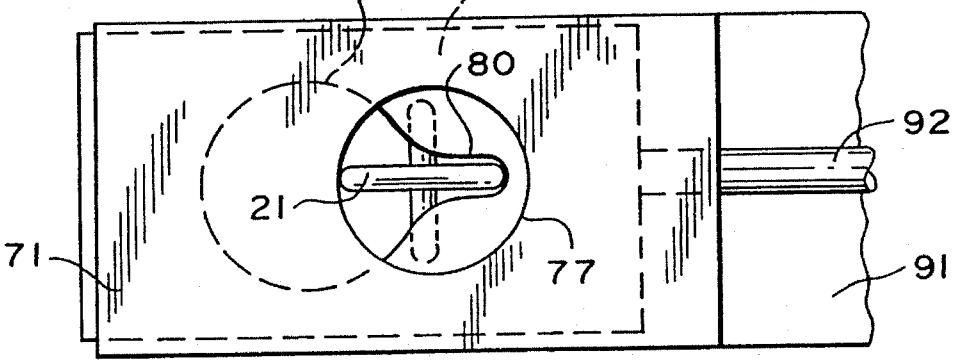
FIG. 7 is a top plan view in the direction of line 7—7 of FIG. 6, showing the sliding plate in a chain-engaging position.

Referring to FIG. 6, when the motor 40 and solenoid 90 are deactivated, the spring 97 expands and pushes the shaft 92 and sliding plate 74 toward the fixed plates 71, 72. When the shaft is fully protracted as illustrated, the circular portion 79 of the opening of the sliding plate is out of alignment with the openings 77, 78 in the fixed plates and the openings 81, 82 in the lubricating plates. Referring to FIG. 7, the elongated portion 80 of the opening of the sliding plate engages the chain 21 and prevents movement of the chain relative to the chain brake. The forward movement of the shaft 92 is limited by the vertical plate 95.

When an individual in a vehicle reaches the security chain barrier, the chain 21 is lowered as illustrated in FIG. 2 to allow the vehicle to drive over it. To lower the chain, the motor 40 is actuated by an electronic transmitter located in the vehicle to cause the reel 50 to unwind the cable. The solenoid 90 is actuated simultaneously with the motor and remains in the non-braking condition shown in FIG. 4 until the motor is deactivated when the chain is fully lowered. The chain links pass through the plates until the chain reaches its lowered position.

Once the chain 21 is fully lowered, the motor 40 and solenoid 90 are simultaneously deactivated by a preset travel limit switch located within the motor. The compressed spring 97 expands and pushes the retractable shaft 92 and sliding plate 74 toward the fixed plates and into the position shown in FIG. 6. In this position of the sliding plate, any large stress exerted on the chain causes the frangible link to open and release the chain.

The apparatus is designed to allow a sufficient length of chain to be protracted so that when the chain is lowered as illustrated in FIG. 2, it rests on a substantial portion of the width of the drive 15 between the posts 10, 11. This allows wide vehicles to drive over the chain without running into the downward extending portions of the lowered chain and possibly causing the frangible link 22 to release the chain.

Once the vehicle drives over the chain, the chain 21 is lifted to the raised position illustrated in FIG. 1. To raise the chain, the motor 40 and solenoid 90 are again actuated to wind the cable on the reel 50 and lift the chain.

Once the chain 21 is raised, the motor 40 and solenoid 90 are deactivated. The sliding plate 74 engages the chain and prevents its further movement. If a vehicle drives into the chain, the frangible link 22 may release the chain and prevent damage to the cable 60, reel 50 and drive shaft 41.

Referring to FIG. 3, stress on the motor 40 and drive shaft 41 are limited by the location, orientation and diameter of the reel 50. The reel shaft 52 is approximately perpendicular to the drive sprocket 42 of the motor. Any external downward force transmitted to the reel through the chain 21 and cable 60 is absorbed by the reel and the pillow blocks 54 and does not damage the drive shaft of the motor.

Another preferred embodiment of the invention is illustrated in FIGS. 10 and 12–15. The security barrier apparatus 20' does not include a cable to move the chain 21, and the chain is wound directly onto a reel 98 by operation of a reversible motor 100. The reel and motor are mounted to a bracket 102 which is fastened to the post 11. The bracket defines vertically extending slots 103, and fasteners 104 extend through the slots and into the post.

Figure 12:
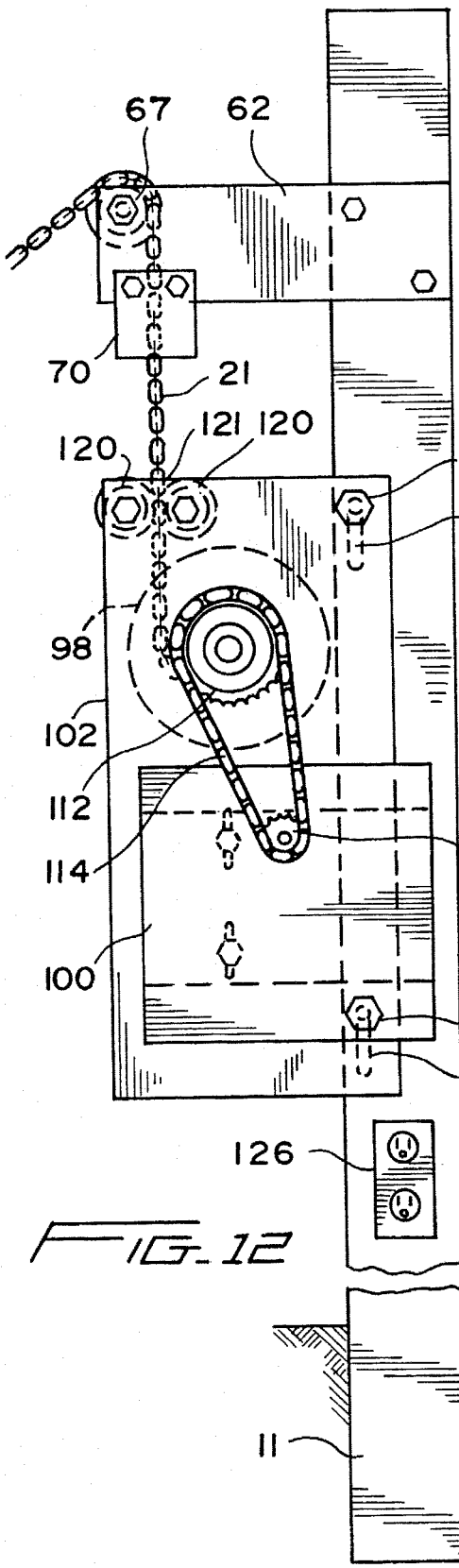
FIG. 12 is a partial side elevational view of the security barrier apparatus of FIG. 10.
Figure 13:
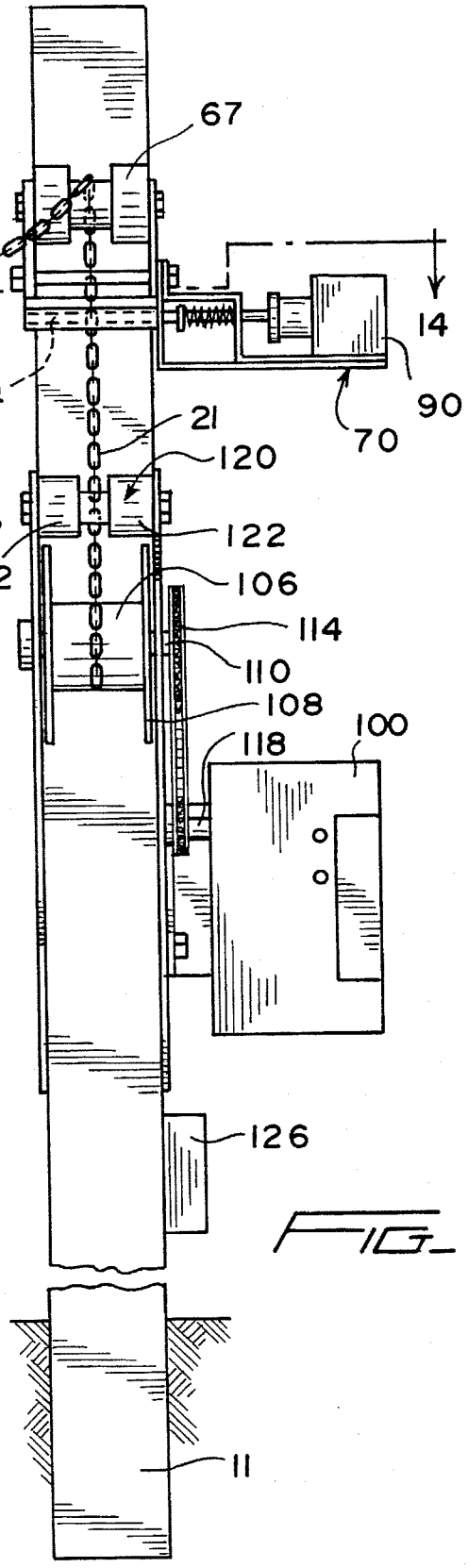
FIG. 13 is a partial front elevational view of the security barrier apparatus of FIG. 10.

As shown in FIGS. 12 and 13, the reel 98 is comprised of a spool 106, side plates 108 and a shaft 110 having a sprocket 112 provided on one end. A link chain 114 connects the sprocket to a sprocket 116 provided on the drive shaft 118 of the motor 100. Operation of the motor causes the chain to be either wound onto or unwound from the reel.

The apparatus comprises a pulley 67 and a chain brake 90 fastened to a bracket 68 which is mounted to the post 11 above the reel 98. The pulley and chain brake are preferably of the same structure as in the embodiment of FIGS. 1–9.

A means for guiding the chain 21, preferably a pair of horizontally aligned pulleys 120, is fastened to the bracket 102 between the chain brake 70 and the reel 98. The pulleys 120 define a space 121 therebetween through which the chain passes as it is wound onto the reel. The space is in vertical alignment with the openings in the plates of the chain brake. The large end portions 122 of each pulley are spaced an effective distance from each other to prevent lateral shifting of the chain and maintain the alignment of the chain with the openings in the chain brake. As the chain is wound onto the reel, the effective diameter of the spool increases. The pulleys 120 compensate for this increase in diameter and consequently prevent chain drag, stress on the motor and noisy operation of the apparatus.

Figure 14:
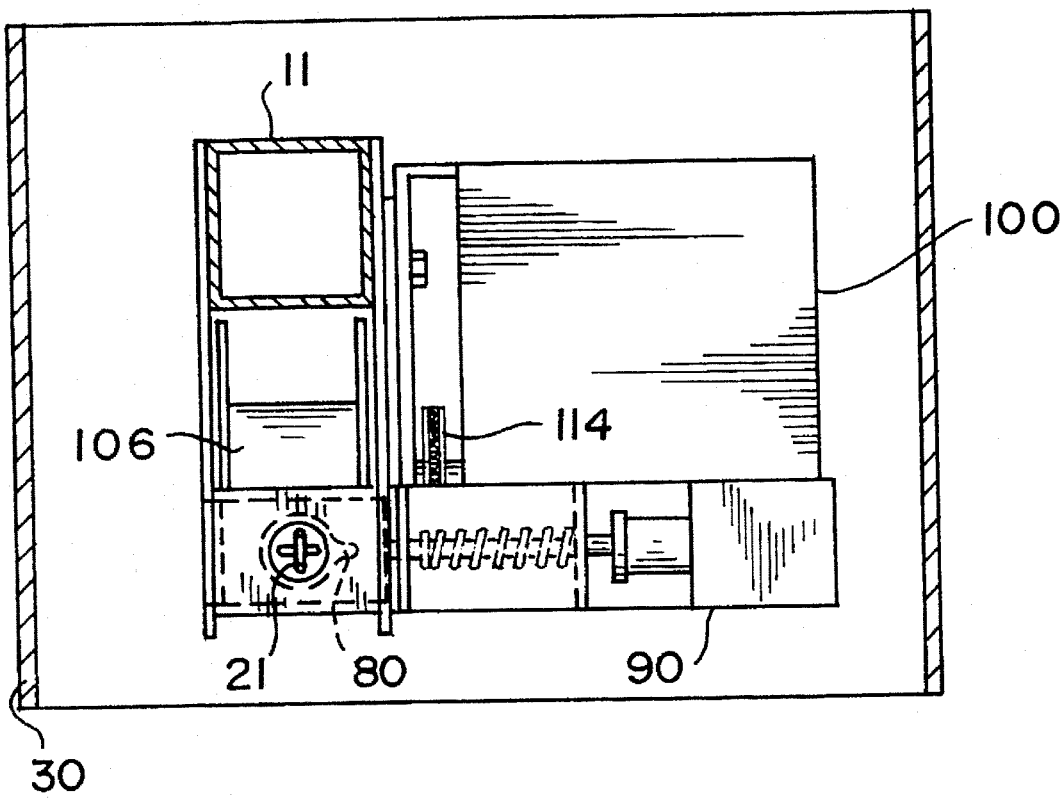
FIG. 14 is a top plan view in the direction of line 14—14 of FIG. 13.

In some instances, when the chain 21 is in a retracted or extended position, chain links positioned inside the chain brake may not fully engage in the elongated portion 80 of the sliding plate 74 (FIG. 14). If an object or vehicle collides with the chain, the chain link must move upward until the chain is captured by the sliding plate.

To enable the chain link to move upward until it is captured by the elongated portion 80 of the sliding plate 74 and consequently to prevent the force of the collision being transmitted through the chain to the drive shaft 118 of the motor 100, the slots 103 formed in the bracket 102 allow the attached reel 98 and motor 100, to move vertically until the chain is captured.

Figure 15:
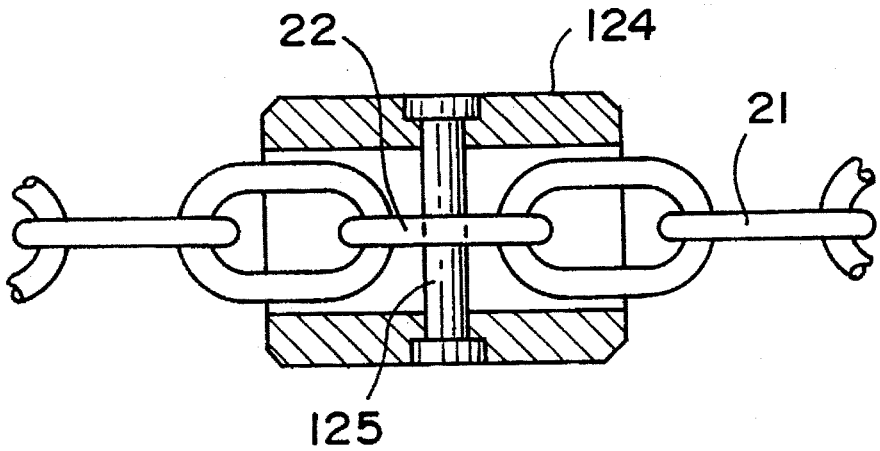
FIG. 15 is a partial cross-sectional view in the direction of line 15—15 of FIG. 10.

A weight 124 is preferably provided on the chain 21 to urge the chain downward toward the post 10 when it is being unwound from the reel and lowered to the fully protracted position shown in FIG. 2. As best shown in FIG. 15, the weight is cylindrical shaped and maintained at a fixed location on the chain by a fastener 125 which extends through the frangible link 22.

Referring to FIGS. 12 and 13, the motor 100 may be electrically connected to an electrical outlet 126 provided on the post 11.

Figure 11:
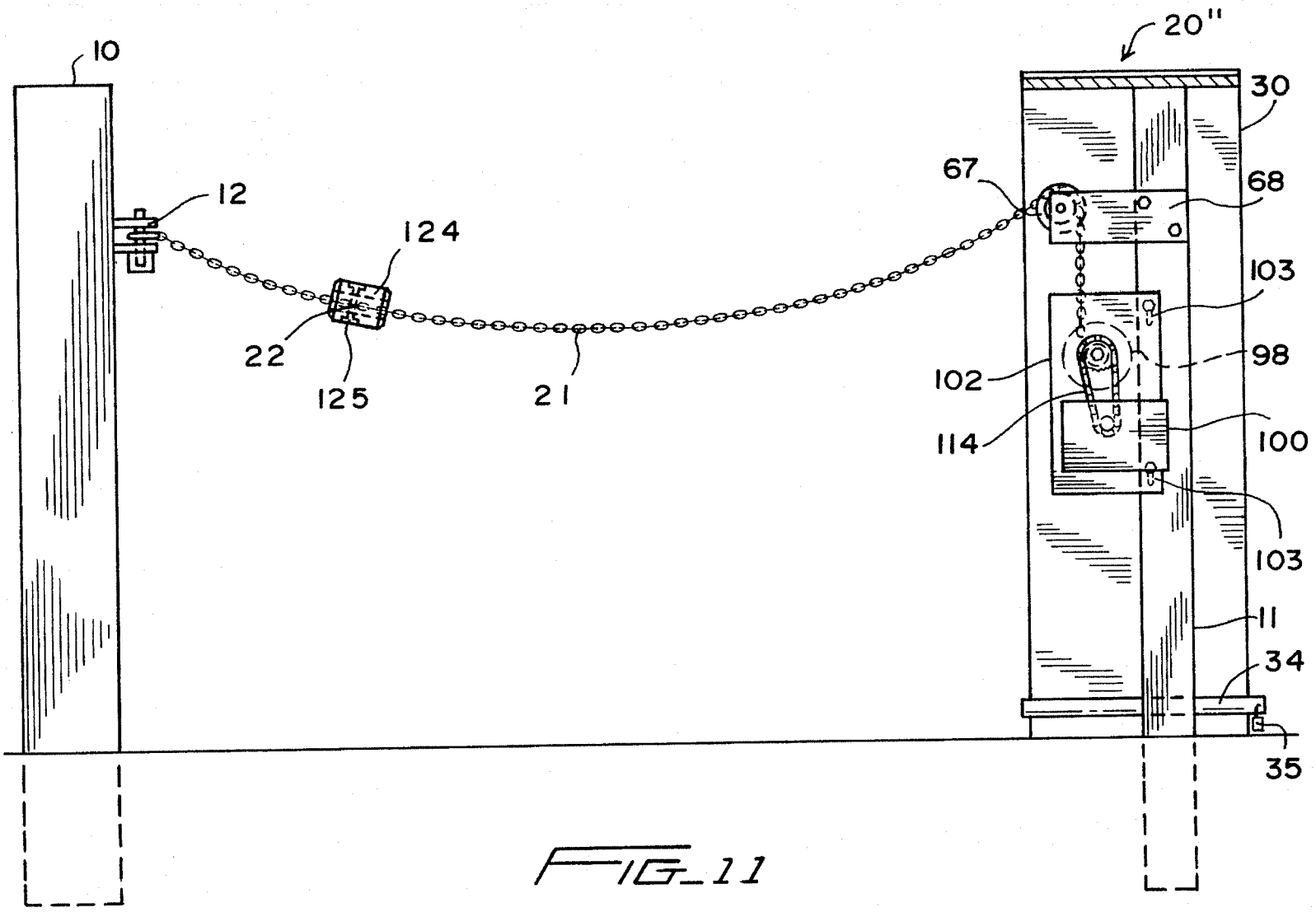
FIG. 11 is an illustrational view of a security barrier apparatus in accordance with a further preferred embodiment of the invention, with the barrier in a raised position.

A further preferred embodiment of the invention is illustrated in FIG. 11. The security barrier apparatus 20" comprises a pulley 67 mounted to a bracket 68, and a reel 98 and motor 100 mounted on a bracket 102 positioned below the pulley 67. The bracket 102 defines vertical slots 103 to enable the bracket to move upward in the event the chain 21 becomes entangled on the pulley 67, so as to prevent excessive stress being conveyed to the motor.

In contrast to the embodiments of the invention shown in FIGS. 1–9 and 10 and 12–15, respectively, the illustrated security barrier apparatus does not include a chain brake. The chain 21 includes a frangible link 22 located inside the weight 124 intermediate the posts 10 and 11. The frangible link opens to disconnect the two chain portions from each other when subjected to a predetermined stress. The predetermined stress is selected so that the frangible link fails before any potentially damaging stress is transmitted to the motor.

The foregoing description of the preferred embodiment of the invention has been presented to illustrate the principles of the invention and not to limit the invention to the particular embodiment illustrated. It is intended that the scope of the invention be defined by all of the embodiments encompassed by the following claims, and their equivalents.

What is claimed is:

1. A security barrier apparatus for use with first and second supports on a surface, the apparatus comprising:

a reversible motor adapted to be mounted to the first support;

a reel connected to and rotatably driven by said motor;

a flexible barrier having a first end secured to said reel and a second end for securing to the second support, said barrier being wound and unwound on said reel by operation of said motor in respective winding and unwinding directions, said barrier being raised above the surface by operation of said motor in the winding direction, and said barrier being lowered onto the surface by operation of said motor in the unwinding direction; and brake means adapted to be mounted to the first support for engaging said barrier in a braking condition in which said motor is deactivated, said barrier being movable relative to said brake means in a non-braking condition in which said motor is operating.

2. The apparatus of claim 1, further comprising a housing adapted to be secured to the first support so as to surround said motor, said reel and said brake means.

3. The apparatus of claim 1, further comprising means for limiting the length of said barrier protracted when said brake means is in the non-braking condition.

4. The apparatus of claim 3, wherein said brake means defines an opening through which said barrier is movable, the limiting means comprises a stop disposed on said barrier, said stop being larger than said opening in said brake means.

5. The apparatus of claim 1, wherein said barrier comprises a chain having a frangible link which fails when a predetermined stress is applied thereto.

6. The apparatus of claim 1, wherein said brake means comprises first and second fixed plates, a sliding plate disposed between the fixed plates, a solenoid including a retractable shaft secured to said sliding plate, and a spring disposed on said retractable shaft, said solenoid is simultaneously actuated with said motor to pull said sliding plate toward said solenoid and compress said spring in the non-braking condition, and said solenoid is simultaneously deactivated with said motor to cause said spring to expand and push said sliding plate away from said solenoid so as to engage said barrier in the braking condition.

7. The apparatus of claim 6, wherein the fixed plates each define a circular opening and the circular openings being aligned with each other, said sliding plate defines a circular opening portion and an elongated opening portion in communication with said circular opening portion, said circular opening portion being substantially aligned with the circular openings in the fixed plates in the non-braking condition, and said circular opening portion being substantially non-aligned with the circular openings in the fixed plates and said barrier is received in said elongated opening portion and engaged by said sliding plate in the braking condition.

8. The apparatus of claim 7, further comprising a lubricating plate disposed between each of the fixed plates and said sliding plate, the lubricating plates each define a circular opening aligned with the circular openings in the fixed plates.

9. The apparatus of claim 1, wherein said motor comprises a drive shaft and a drive sprocket disposed on said drive shaft, said reel comprises a reel shaft and a reel sprocket disposed on said reel shaft, a connecting chain connecting said drive sprocket to said reel sprocket such that said reel shaft is rotatably driven by said drive shaft, said reel shaft being approximately perpendicular to said reel sprocket and said drive sprocket.

10. The apparatus of claim 1, wherein said motor is electrically powered and remotely actuated by a wireless transmitter.

11. The apparatus of claim 1, wherein said motor and said reel are mounted to a bracket, and said bracket is fastenable to the first support so as to be vertically movable relative thereto.

12. A security barrier apparatus for use with first and second supports on a surface, the apparatus comprising:

a reversible motor;

a reel connected to and rotatably driven by said motor, said motor and said reel being mounted to a bracket, and said bracket being fastenable to the first support and vertically movable relative thereto; and a flexible barrier having a first end secured to said reel and a second end for securing to the second support, said barrier being wound and unwound on said reel by operation of said motor in respective winding and unwinding directions, and said barrier being raised above the surface by operation of said motor in the winding direction, and being lowered toward the surface by operation of said motor in the unwinding direction.

13. The apparatus of claim 12, wherein said barrier comprises a chain, and said apparatus further comprising a chain guide adapted to be mounted to the first support above said reel.

14. The apparatus of claim 13, wherein said chain includes a frangible link which fails when a predetermined force is applied to said chain, and comprising a weight disposed on said chain intermediate said chain guide and said second end.

15. The apparatus of claim 12, wherein said motor comprises a drive shaft and a drive sprocket disposed on said drive shaft, said reel comprises a reel shaft and a reel sprocket disposed on said reel shaft, a linking chain connects said drive sprocket to said reel sprocket such that said reel shaft is driven by said drive shaft when said motor is operating and said reel shaft is approximately perpendicular to said reel sprocket and said drive sprocket.

16. The apparatus of claim 12, further comprising a housing adapted to be secured to the first support so as to surround said motor, said reel and said brake means.

17. A security barrier apparatus for use with first and second supports which protrude upwardly from a surface, the apparatus comprising:

a reversible motor adapted to be mounted to the first support;

a reel connected to and rotatably driven by said motor;

a chain having a first end secured to said reel and a second end for securing to the second support, said chain being wound and unwound on said reel by operation of said motor in respective winding and unwinding directions, and said chain being raised above the surface by operation of said motor in the winding direction and lowered toward the surface by operation of said motor in the unwinding direction;

brake means for engaging said chain, said brake means engaging said chain in a braking condition in which said motor is deactivated, and said chain being movable relative to said brake means in a non-braking condition in which said motor is operating; and a chain guide adapted to be mounted to the first support above said reel.

18. The apparatus of claim 17, further comprising means for limiting the length of chain which may be protracted in the non-braking condition, and said chain includes a frangible link which fails when a predetermined force is applied to said chain.

19. The apparatus of claim 17, wherein said brake means defines an opening, and said chain guide defines a space in alignment with said opening, through which said chain passes, said apparatus further comprising a pulley adapted to be mounted to the first support above said chain guide, and said chain passes through said space and about said pulley when being raised and lowered.

20. The apparatus of claim 17, further comprising a housing adapted to be secured to the first support and to surround said motor, said reel, said brake means and said chain guide.

* * * * *